United States Patent [19]

Mueller

[11] 4,151,817

[45] May 1, 1979

[54] ENGINE VALVE CONTROL MECHANISM

[75] Inventor: Robert S. Mueller, Birmingham, Mich.

[73] Assignee: Eaton Corporation, Cleveland, Ohio

[21] Appl. No.: 906,305

[22] Filed: May 12, 1978

Related U.S. Application Data

[63] Continuation of Ser. No. 750,924, Dec. 15, 1976.

[51] Int. Cl.[2] ..... F01L 1/34; F02D 13/06

[52] U.S. Cl. ..... 123/90.16; 123/90.17; 123/90.27; 123/198 F

[58] Field of Search ..... 123/90.15, 90.16, 90.17, 123/90.18, 90.22, 90.27, 198 F

[56] References Cited

U.S. PATENT DOCUMENTS

| | | | |
|---|---|---|---|
| 2,266,077 | 12/1941 | Roan | 123/90.16 |
| 2,392,933 | 1/1946 | Mallory | 123/198 F |
| 2,934,052 | 4/1960 | Longenecker | 123/90.16 |
| 3,277,874 | 10/1966 | Wagner | 123/90.16 |
| 3,641,988 | 2/1972 | Torazza et al. | 123/90.16 |
| 3,964,455 | 6/1976 | Brown | 123/90.16 |
| 4,050,435 | 9/1977 | Fuller | 123/198 F |
| 4,064,861 | 12/1977 | Schulz | 123/198 F |

*Primary Examiner*—Ira S. Lazarus

*Attorney, Agent, or Firm*—D. Wood; P. Rulon; R. J. McCloskey

[57] ABSTRACT

An engine valve control mechanism for varying the amount of opening and/or timing of cylinder valve in a valve gear train of a multi-cylinder, internal combustion engine having an overhead camshaft which actuates the valve via a rocker arm pivotally bridged between the valve stem and a hydraulic lash adjuster. In one engine embodiment of the invention the valve gear train portion for each intake valve is provided with a valve control mechanism of the invention by providing a camshaft having a high lift lobe and two low lift lobes for actuating the valve and by providing a valve rocker arm including a rigid link defining a first cam follower for following the low lift lobes and a second cam follower pivotally connected to the rigid link for following the high lift lobe. A latch carried by the rigid link is operative in a first position to prevent pivotal movement of the second follower relative to the rigid link, whereby the valve is actuated by the high lift lobe, and operative in a second position to allow such pivotal movement, whereby the valve is actuated by the low lift lobes. In a second embodiment the low lift lobes are removed, whereby the valves are disabled when the latch is in the second position.

22 Claims, 7 Drawing Figures

ENGINE VALVE CONTROL MECHANISM

This is a continuation of application Ser. No. 750,924 filed Dec. 15, 1976.

BACKGROUND OF THE INVENTION

1. Field of the Invention

The invention relates to a mechanism for controlling a valve actuated by a camshaft and more specifically to a mechanism to vary the amount of opening and/or timing of cam actuated valves.

2. Description of the Prior Art

It is well known in the internal combustion engine art that a more flexible control of the engine valves will provide improved power and economy at virtually all engine speeds and loads. One method of providing more flexible valve control is taught in U.S. Pat. Nos. 2,934,052 and 3,277,874. Therein the camshafts are provided with high and low lift lobes for actuating each of the engine valves and means selectively operative to shift from valve actuation by one of the lobes to valve actuation by other of the lobes for varying the amount of valve opening and/or valve timing in accordance with engine operating conditions. It is also well known in the internal combustion engine art that improved operating economy may be obtained by disabling the valves of selected cylinders during certain engine operating conditions, for example, when the engine is lightly loaded. Another method of providing more flexible valve control is concerned with the concept of completely disabling selected valves when the engine is lightly loaded. Prior U.S. patent art is replete with patents teaching valve disablement.

SUMMARY OF THE INVENTION

According to a feature of this invention, a valve control rocker arm is provided which includes a rigid link adapted to be pivotally interposed between a camshaft and a valve of an internal combustion engine, a cam follower moveably mounted on the link and adapted to follow a cam lobe defined by the camshaft, and a latch operative in first and second positions, respectively, to prevent and allow movement of the cam follower relative to the link, whereby the cam lobe is selectively made effective and ineffective for actuating the valve.

According to a further feature of the invention, the camshaft includes a smooth cylindrical surface portion concentric to its rotational axis and adjacent to the cam lobe, and the rigid link includes a follower portion in contact with the cylindrical portion, whereby the valve is completely disabled when the latch allows movement of the cam follower relative to the rigid link.

According to a further feature of the invention the camshaft includes a second cam lobe projecting from the smooth cylindrical surface portion, whereby the valve is actuated by the second cam lobe when latch allows movement of the cam follower relative to the rigid link.

BRIEF DESCRIPTION OF THE DRAWINGS

The preferred embodiment of the invention is shown in the accompanying drawings in which.

DETAILED DESCRIPTION OF THE INVENTION

Figure 1:
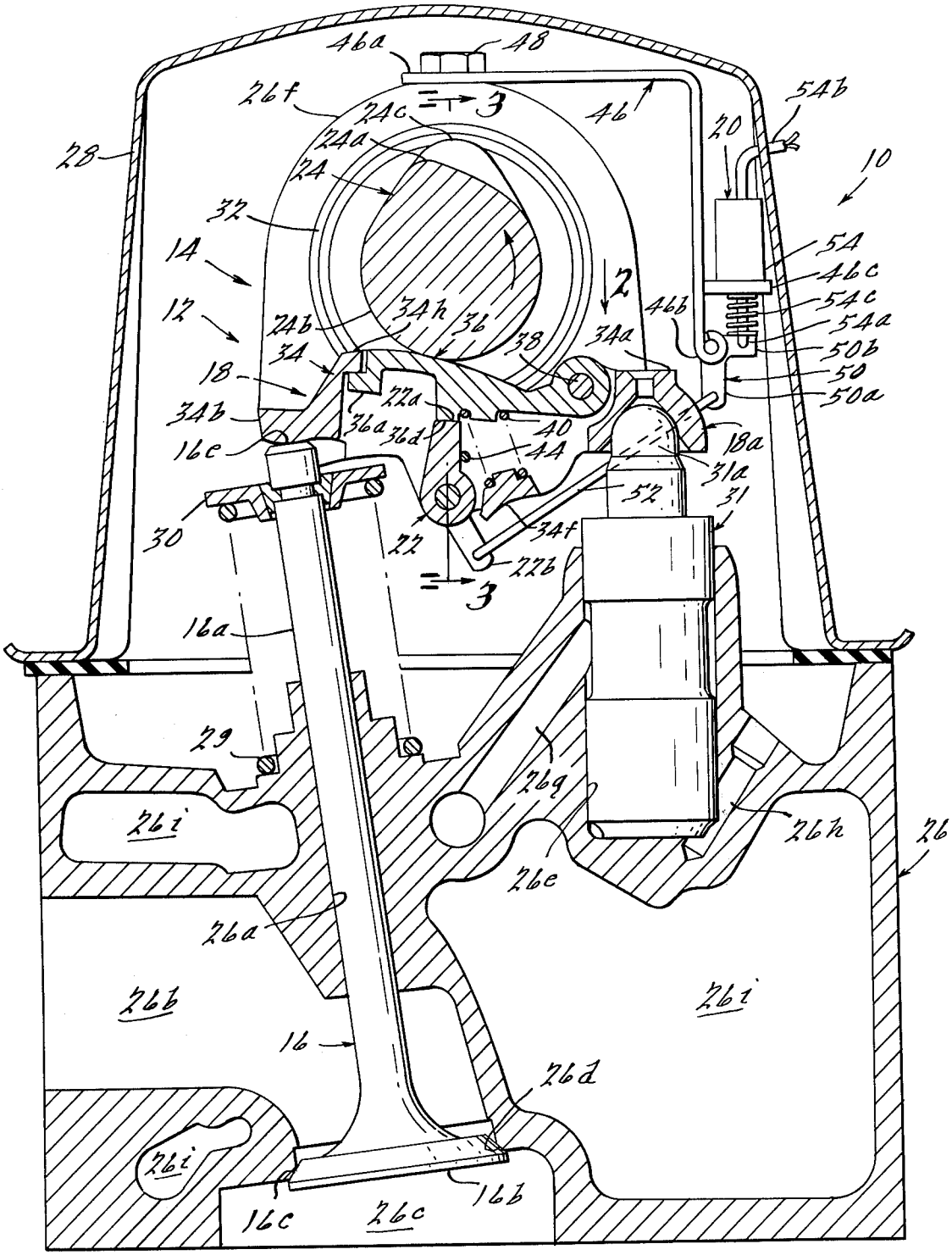
FIG. 1 is a partially sectioned view of an internal combustion engine cylinder head embodying a valve control rocker arm and camshaft of the invention valve control mechanism.

Referring now to FIG. 1, therein is shown in cross-section an internal combustion engine cylinder head assembly 10 of the overhead camshaft type and the inventive valve control mechanism 12 adapted to readily fit into a valve gear train portion 14 for actuating an engine cylinder valve 16. The valve control mechanism includes a rocker arm mechanism 18 which replaces a conventional rocker arm, a solenoid mechanism 20 for positioning a latch 22 carried by rocker arm 18, and a camshaft 24 which replaces a conventional camshaft.

The head assembly 10 forms no part of the invention and is shown to merely provide one example of the type of environment in which valve control mechanism 12 may be embodied. The head assembly includes valve gear train 14, a cast head structure 26, and a sheet metal valve cover 28.

Valve 16 is of the poppet type having a stem portion 16*a* slideably disposed in a guide 26*a* defined by head structure 26 and a valve head portion 16*b*. Valve head portion 16*b* blocks the flow of gases between a passage 26*b* and a recess 26*c* when a conical face 16*c* on the valve head rests on a mating valve seat 26*d* defined or supported by the head structure. Recess 26*c* opens into an unshown combustion chamber which may be cylindrically shaped and have therein a reciprocating piston. Valve 16 is biased to the closed position by a spring 29 which reacts between the head structure and a conventional valve spring retainer 30.

The valve gear train portion 14 is substantially conventional with the exception of the valve control mechanism. Valve gear train portion 14 includes valve 16, rocker arm 18 pivotally supported at one end 18*a* by a hydraulic lash adjuster 31 contained in a bore 26*e* defined by the head structure, camshaft 24 journaled in a bearing 32 supported by an arched portion 26*f* defined by the head structure. Lash adjuster 31 includes a piston having a hemispherical end 31*a* for pivotally supporting one end of the rocker arm.

The head structure 26 includes in addition to the above, a passage 26*g* for supplying pressurized oil to the lash adjuster, a passage 26*h* for draining bore 26*e* and assisting in the installation of the adjuster, and three irregularly shaped coolant passages 26*i*.

Figure 2:
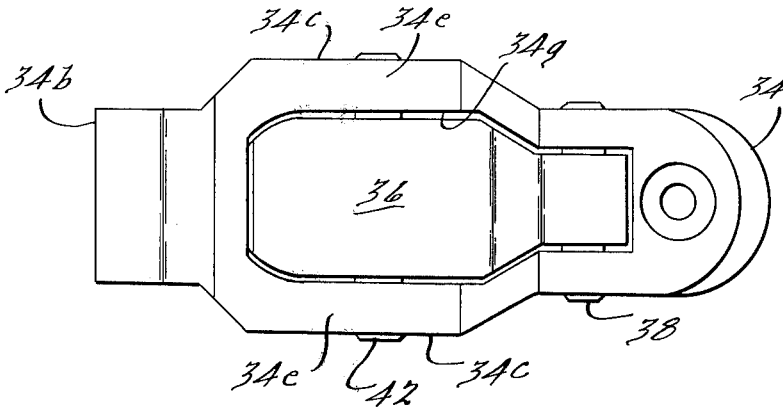
FIG. 2 is a view of the rocker arm looking in the direction of arrow 2 of FIG. 1.
Figure 3:
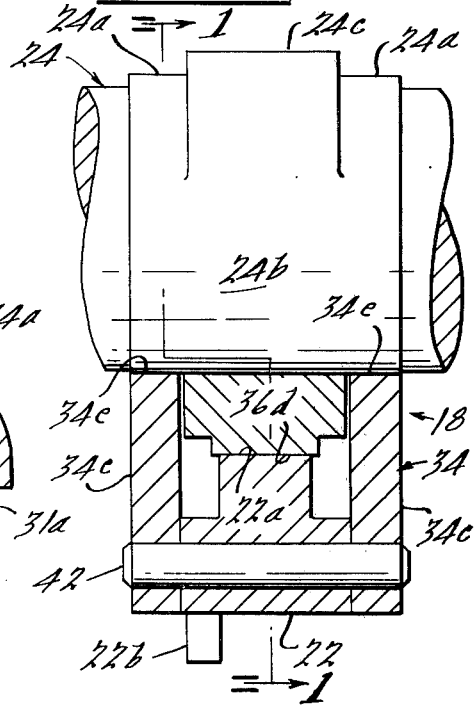
FIG. 3 is a sectional view of the rocker arm and camshaft looking in the direction of arrows 3—3 of FIG. 1.

Referring now to FIGS. 1, 2, and 3, the cross-section of the rocker arm and camshaft of FIG. 1 is taken along the line 1—1 of FIG. 3 and the cross-section of FIG. 3 is taken along the line 3—3 of FIG. 1.

Camshaft 24 includes a smooth circumferential surface which may be machined or finished by well known methods to define a first surface portion which includes a first pair of low lift cam lobes 24*a* projecting radially outward from a cylindrical surface or dwell portion 24*b* and a second high lift cam lobe 24*c* of substantially conventional height and profile and interposed between lobes 24*a*. Cylindrical surface 24*b* is common to lobes 24a and lobe 24c, concentric to the axis of the camshaft, and defines what is commonly referred to as the base circle of the cam lobes.

High lift cam lobe 24c is for effecting a full opening of valve 16 during relatively high engine loading. Low lift cam lobes 24a are for effecting a partial opening of valve 16 during relatively low engine loading. Cam lobes 24a have identical height and circumferential positions with respect to each other and are completely confined within the circumferential and radial extent of the profile of cam lobe 24c.

Rocker arm mechanism 18 includes an elongated rigid one piece link 34, a cam follower 36 pivotally hinged to the link by a pin 38, the latch 22 selectively operative to prevent movement of follower 36 relative to the link, and a helical spring 40 for biasing cam follower 36 toward engagement with the conventional cam lobe 24c.

Rigid link 34 is pivotally bridged or supported at its ends by the lash adjuster 31 and the valve 16 in a conventional manner. Rigid link 34 includes an end portion 34a adapted to pivotally receive the hemispherical end 31a of the lash adjuster, an end portion 34b adapted to drivingly engage an end portion 16e of the valve stem, and two rail portions 34c. Rail portions 34c rigidly interconnect the end portions, define surface portions or first cam followers 34e which drivingly engage the low lift cam lobes on the first surface portions of the camshaft, carry a pin 42 for pivotally supporting the latch 22, carry or include a bridge portion 34f for supporting one end of spring 40 and for limiting travel of the latch in the counterclockwise direction, and carry a pin 44 for limiting clockwise travel of the latch. End portions 34a and 34b and rails 34c define a space or opening 34g which receives cam follower 36.

Figure 4:
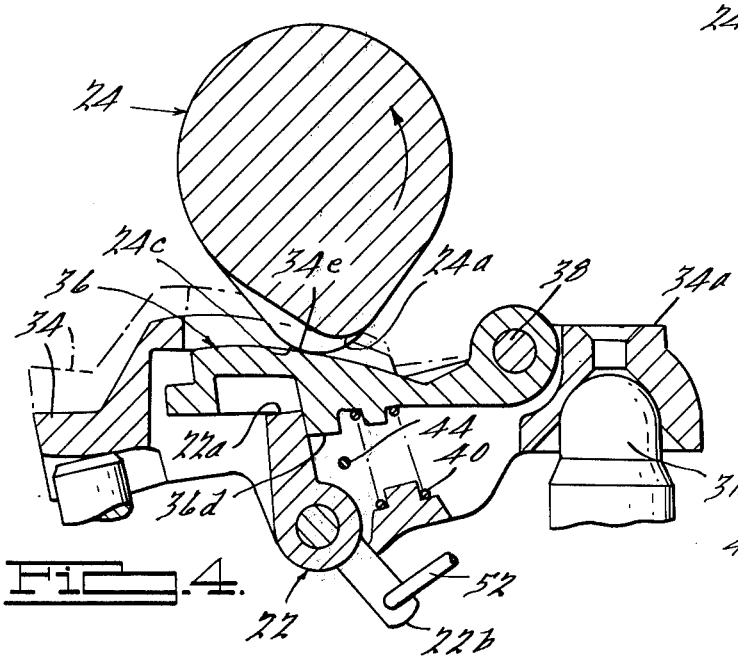
FIG. 4 depicts an operational mode of the rocker arm of FIG. 1.

Cam follower 36 may be considered a second cam follower and as mentioned is pivotally hinged to the link by pin 38 for movement within opening 34g. The left end of second cam follower 36 includes 34g. lip portion 36a, which lip engages a stop 34h defined by the link for limiting upward travel of the second cam follower with respect to the link, and a middle portion defining a downwardly facing surface portion 36d for engaging a surface 22a of latch 22 and preventing movement of the second cam follower relative to the link when latch 22 is in a first position, as shown in FIG. 1. When latch 22 is in a second position, as shown in FIG. 4, cam follower 36 is free to move relative to link 34, thereby rendering cam lobe 24c ineffective and allowing cam lobes 24a to actuate the valve.

Solenoid assembly 20 includes a support bracket 46 fixed at one end 46a to arched portion 26f of the head structure by a fastener 48 and having a fulcrum 46b pivotally supporting an L-shaped lever 50 having one leg 50a connected to an arm portion 22b of the latch by a linkage 52 and having the other leg 50b connected to an armature 54a of a solenoid 54. Solenoid 54 is supported by a tab portion 46c of the bracket and is conectable to an electrical source of power by a conductor 54b extending through an opening in valve cover 28. Latch 22 is biased to the latched or first position, as shown in FIG. 1, by a spring 54c reacting between tab portion 46c and lever 50. Latch 22 is rotated to the unlatched or second position, as shown in FIG. 4, in response to energization of the solenoid by the power source. The power source may be manually controlled or automatically controlled in response to engine operating conditions.

In FIG. 1 the point of connection of lever 50 with linkage 52 is shown to the right and above the center of hemispherical end 31a of the lash adjuster; this is done herein mainly to illustrate lever 50 and the connection of linkage 52 to the lever. This arrangement will cause an undesirable to and fro pivotal movement of latch 22 whenever the rocker arm pivots about the center of the hemispherical end. This movement may be negated by loosely connecting the linkage to arm portion 22a and lever 52 or substantially prevented by placing the lever behind end 31a of the rocker arm and positioning the point of connection as close as possible to the center of the hemispherical end so that the linkage (at its point of connection to the lever) and the rocker arm will pivot about a relatively common axis.

From the foregoing it should be apparent that a part of the camshaft is always in unyielding contact with the rigid link of the rocker arm regardless of the position of latch 22. For example, when the valve is inactive or closed, the cylindrical surface of dwell portion 24b of the base circle, as shown in FIG. 1, is in direct contact with the first cam followers defined by the rigid link. When latch 22 is in the first position, preventing movement of the second cam follower relative to the rigid link, cam lobe 24c is unyieldably connected to the rigid link via the latch 22. And when latch 22 is in the second, position allowing movement of the second cam follower relative to the rigid link, cam lobes 24a are unyieldably connected to the rigid link. This unyielding contact between the camshaft and the rigid link of the rocker arm prevents ballooning or over extension of hydraulic lash adjuster 31 or any anlogous device for automatically removing lash from the valve gear train and allows the use of a relatively low force spring 40 for biasing the second cam follower. However, the force of spring 40 could be increased to prevent ballooning of the lash adjuster.

Operation of valve control mechanism 12 is rather evident from the foregoing description and drawings. When latch 22 is in the first position, as shown in FIG. 1, latch 22 prevents movement of second cam follower 36 relative to rigid link 34 and cam lobe 24c actuates valve 16 by moving the second cam follower and the rigid link in unison in response to rotation of the camshaft. When latch 22 is in the second position, as shown in FIG. 4, latch 22 allows movement of second cam follower 36 relative to rigid link 34 and cam lobes 24a contact the first cam followers 34e defined by the upper surface portion of the rigid link, whereby the valve is actuated by cam lobes 24a and cam lobe 24c is ineffective.

Figure 5:
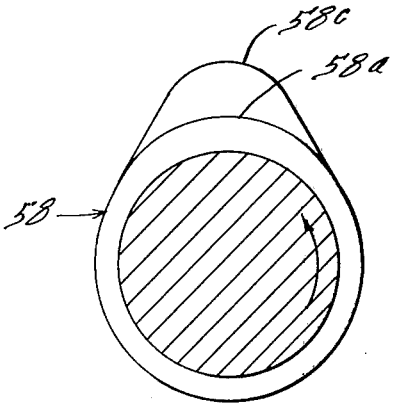
FIGS. 5, 6, and 7 depict alternatives to the cam lobe arrangement of FIG. 1.
Figure 6:
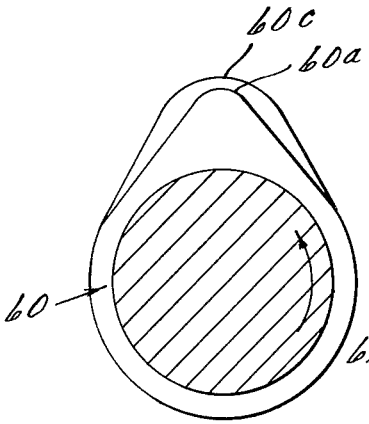
Figure 7:
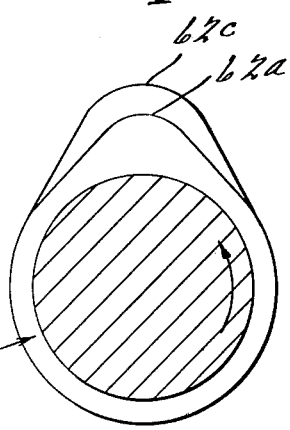

FIGS. 5, 6, and 7 depict alternatives to the cam lobe arrangement of FIGS. 1, 3 and 4. In FIG. 5 a camshaft 58 is provided with one high lift cam lobe 58c corresponding substantially with high lift cam lobe 24c of camshaft 24 and two cylindrical surfaces 58a concentric to the rotational axis of the camshaft and separated by cam lobe 58c, whereby the valve 16 is completely disabled when latch 22 allows movement of second cam follower 36 relative to rigid link 34. FIGS. 6 and 7 merely show two of many cam profile arrangements which may be used with rocker arm 18. In FIG. 6 a camshaft 60 is provided with a high lift cam lobe 60c which will hold valve 16 open for about 140 degrees of camshaft rotation and a pair of cam lobes 60a having substantially the same lift as cam lobe 60c but will hold valve 16 open for a fewer number of degrees of camshaft rotation. In FIG. 7 a camshaft 62 is provided with a high lift cam lobe 62c corresponding substantially to high lift cam lobe 24c of camshaft 24 and a pair of low lift cam lobes 62a corresponding in lift to low lift cam lobes 24a but timed differently with respect to the high lift cam lobe.

A preferred embodiment of the invention has been disclosed for illustrative purposes. Many variations and modifications of the preferred embodiment are believed to be within the spirit of the invention. The following claims are intended to cover the inventive portions of the preferred embodiment and variations and modifications believed to be within the spirit of the invention.

What is claimed is:

1. A valve control rocker arm means adapted for incorporation into an internal combustion engine valve gear train including a cylinder valve and a camshaft having a cam lobe, said rocker arm means comprising:

rigid link means adapted to be pivotally interposed between the camshaft and the valve;

cam follower means mounted on and moveable relative to said rigid link means and adapted to follow the contour of the cam lobe; and latch means selectively moveable between first and second positions, said latch means operative in said first position to prevent movement of said cam follower means relative to said link means for effecting actuation of said valve by said cam lobe, and said latch means operative in said second position to allow movement of said cam follower relative to said link means, whereby said cam lobe is at least partially ineffective for actuating said valve.

2. The rocker arm of claim 1, further including:

hinge means for pivotally connecting said cam follower means to said link means.

3. The rocker arm of claim 1, further including:

spring means for biasing said cam follower means toward said cam lobe.

4. The rocker arm of claim 1, wherein said rigid link means is an elongated link having one end means adapted to be pivotally supported, an other end means adapted to drivingly engage the engine valve, and rail means rigidly interconnecting said end means, and wherein said follower means is mounted in a space defined by said end means and said rail means.

5. The rocker arm of claim 4, further including:

hinge means for pivotally connecting said cam follower means to one of said end means.

6. The rocker arm of claim 5, further including:

spring means for biasing said cam follower means toward said cam lobe.

7. The rocker arm of claim 6, wherein said elongated link means includes:

reaction means for supporting one end of said spring means; and means for supporting said latch means.

8. A valve control rocker arm adapted for incorporation into an internal combustion engine valve gear train including at least one cylinder valve and a camshaft having at least one cam lobe, said rocker arm means comprising:

an elongated link means having one end means adapted to be pivotally supported, an other end means adapted to drivingly engage the valve, and two spaced apart rail means rigidly interconnecting said end means and defining an opening therebetween;

a cam follower supported in said opening for movement relative to said link means and adapted to follow the contour of the cam lobe;

latch means supported by said elongated link means and selectively moveable between first and second positions, said latch means operative in said first position to prevent movement of said cam follower relative to said link means for effecting actuation of said valve by said cam lobe, and said latch means operative in said second position to allow movement of said cam follower means relative to said rigid link means, whereby said cam lobe is ineffective to actuate said valve.

9. The rocker arm of claim 8, further including:

spring means for biasing said cam follower means toward said cam lobe.

10. The rocker arm of claim 8, further including:

hinge means for pivotally connecting said cam follower to one of said end means.

11. In an internal combustion engine having at least one cylinder valve, wherein the improvement comprises:

a camshaft mounted for rotation in said engine and including a circumferential surface defining a first surface portion and a cam lobe projecting radially outward from the circumferential surface and axially adjacent to the first surface portion;

rigid link means defining on a surface thereof a first follower means in direct contact with said first surface portion of said camshaft and having another surface in direct driving contact with said valve;

a second follower means disposed adjacent said first follower means, moveable relative to said rigid link means, and in direct contact with said cam lobe;

latch means selectively moveable between first and second positions, said latch means operative in said first position to prevent movement of said second follower means relative to said link means for effecting actuation of said valve by said cam lobe, and said latch means operative in said second position to allow movement of said second follower means relative to said link means, whereby said cam lobe is at least partially ineffective for actuating said valve.

12. The improvement of claim 11, wherein said first surface portion of said camshaft defines a cylindrical surface concentric to the axis of said camshaft and said valve is completely disabled when said latch means is in said second position.

13. The improvement of claim 11, wherein said first surface portion of said camshaft defines a second cam lobe confined within the circumferential and radial extent of said first mentioned cam lobe for effecting actuation of said valve when said latch is in said second position.

14. The improvement of claim 11, wherein said rigid link means is an elongated link having one end portion pivotally mounted on means supported by said engine, the other end portion drivingly engaging said valve, and a center rail portion rigidly interconnecting said end portions and defining said first follower means.

15. The improvement of claim 14, further including:

hinge means pivotally connecting said second follower to said rigid link means.

16. The improvement of claim 14, further including:

spring means for biasing said second follower means into engagement with said cam lobe.

17. In an internal combustion engine having at least one cylinder valve, wherein the improvement comprises:

a camshaft mounted for rotation in said engine and including first and second cam lobes projecting radially outward from a common surface concentric to the axis of said camshaft, said first cam lobe having a lower lift and being adjacent to said second cam lobe;

an elongated rigid link means having one end portion pivotally mounted on means supported by said engine, the other end portion drivingly engaging said valve, a center portion rigidly interconnecting said end portions and defining on a surface thereof first cam follower means operative to drivingly engage said first cam lobe and a portion of said circumferential surface;

a second cam follower means disposed adjacent said first cam follower means moveable relative to said elongated link;

resilient means for biasing said second cam follower means into driving engagement with said second cam lobe and a portion of said circumferential surface; and latch means selectively moveable between first and second positions, said latch means operative in said first position to prevent movement of said second cam follower means relative to said elongated link means for effecting actuation of said valve by said second cam lobe, and said latch means operative in said second position to allow movement of said second cam follower means relative to said elongated link means for rendering said second cam lobe ineffective and for effecting actuation of said valve by said second cam lobe.

18. In an internal combustion engine having at least one cylinder valve, wherein the improvement comprises:

a camshaft mounted for rotation in said engine and including a circumferential surface defining a first surface portion concentric to the axis of said camshaft and a cam lobe projecting radially outward from the circumferential surface and axially adjacent to said first surface portion;

an elongated rigid link means having one end portion pivotally mounted on means supported by said engine, the other end portion drivingly engaging said valve, and a center portion rigidly interconnecting said end portions and defining on a surface thereof a first follower operative to drivingly engage said first surface portion;

cam follower means disposed adjacent said first follower means and moveable relative to said elongated link;

resilient means for biasing said second cam follower into driving engagement with said cam lobe;

latch means selectively moveable between first and second positions, said latch means operative in said first position to prevent movement of said cam follower means relative to said elongated link means for effecting actuation of said valve by said cam lobe, and said latch means operative in said second position to allow movement of said cam follower relative to said elongated link means for rendering said cam lobe ineffective and disabling said valve.

19. A device for varying the timing of the cyclic opening and closing of the combustion chamber valves of an internal combustion engine in relation to the engine shaft, said device comprising:

cam means moved in response to movement of the engine shaft, said cam means including means operable to cyclically provide a first valve lift motion in predetermined relationship to the movement of the engine shaft and a period of dwell wherein said motion is not provided, and means operable to cyclically provide a second valve lift motion at a predetermined differential from said first motion with respect to movement of the engine shaft and a period of dwell wherein said second motion is not provided;

cam follower means operable to receive and transmit said first and second valve lift motion from said cam means; and latch means selectively moveable between a first and second state, said latch means being operative in said first state to effect transmission of said first valve lift motion from said cam follower means for effecting opening and closing of the engine valves, said latch means being operative in said second state to effect transmission of only said second valve lift motion from said cam follower means for opening and closing said valve means, said latch means being selectively moveable between said first and second states only when said cam means is in said first and second dwell periods with respect to said cam follower means.

20. A device for controlling the lift from its seat of an engine poppet valve in the valve gear of an internal combustion engine having cam means operable to move cyclically in timed relationship with rotation of the engine shaft for providing valve lift motion, said device comprising:

link means adapted for pivotal mounting on the engine;

cam follower means moveably connected to said link means and operable in a first position with respect thereto to contact said cam means for providing a certain valve lift in response to said cyclic movement of said cam means, said cam follower being moveable to a second position with respect to said link means and in which said second position said cam follower is operable to contact said cam means for providing a lift substantially less than said certain valve lift; and latch means selectively operable to secure and release said cam follower means in said first position.

21. A device for controlling the lift from its seat of an engine poppet valve in the valve gear of an internal combustion engine having cam means operable to move cyclically in timed relationship with rotation of the engine shaft for providing a certain valve lift motion, said device comprising:

link means adapted for pivotal mounting on the engine;

cam follower means moveably connected to said link means and adapted to contact said cam means, said follower means having a first locked condition and being operable therein upon contacting said cam means to provide said certain lift in response to said cyclic motion of said cam means, said cam follower means operable when released from said first position to absorb a portion of said certain lift as lost motion; and latch means selectively actuatable to secure and release said follower means from said locked position.

22. In an internal combustion engine having a poppet valve lifted from a seat and cam means cyclically moveable in timed relationship with rotation of the engine shaft to provide valve lift motion, the improvement comprising:

link means pivotally mounted on said engine and including means contacting said poppet valve and operable to move same from its seat upon movement of said link means;

cam follower means moveably mounted on said link means, said cam follower contacting said cam means and being operative when secured in a first position to cause said link means to provide a certain valve lift, said follower means being operable when released to move with respect to said link means to move to a second position to absorb a portion of said certain valve lift as lost motion; and latch means selectively operable to lock and release said follower means in said first position.

* * * * *